US008149206B2

(12) United States Patent
Kim et al.

(10) Patent No.: US 8,149,206 B2
(45) Date of Patent: Apr. 3, 2012

(54) LIQUID CRYSTAL DISPLAY AND METHOD OF CONTROLLING THE SAME

(75) Inventors: Euitae Kim, Seoul (KR); Yongwoo Choi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 484 days.

(21) Appl. No.: 12/465,876

(22) Filed: May 14, 2009

(65) Prior Publication Data

US 2010/0149085 A1 Jun. 17, 2010

(30) Foreign Application Priority Data

Dec. 16, 2008 (KR) ..... 10-2008-0128100

(51) Int. Cl.
*G09G 3/36* (2006.01)

(52) U.S. Cl. ..... 345/102

(58) Field of Classification Search ..... 345/1.1, 345/87, 102; 349/61, 63–65
See application file for complete search history.

(56) References Cited

U.S. PATENT DOCUMENTS

| | | | | |
|---|---|---|---|---|
| 6,937,224 | B1 * | 8/2005 | Miyachi | 345/102 |
| 2004/0114396 | A1 * | 6/2004 | Kobayashi et al. | 362/561 |
| 2007/0262948 | A1 * | 11/2007 | Han et al. | 345/102 |
| 2008/0001881 | A1 * | 1/2008 | Baba et al. | 345/89 |
| 2008/0007512 | A1 * | 1/2008 | Honbo | 345/102 |
| 2008/0186324 | A1 * | 8/2008 | Chiang | 345/589 |

* cited by examiner

*Primary Examiner* — Chanh Nguyen
*Assistant Examiner* — Pegeman Karimi
(74) *Attorney, Agent, or Firm* — Birch, Stewart, Kolasch & Birch, LLP

(57) ABSTRACT

A liquid crystal display includes a liquid crystal display panel, a first and a second light emitting diode (LED) light source unit configured to irradiate light onto the liquid crystal display panel, a light source drive circuit configured to individually drive the first and second LED light source units, and a light source controller configured to generate the address signal and dimming signal and transmit the address signal and dimming signal to the light source drive circuit in a self screen mode.

18 Claims, 8 Drawing Sheets

LIQUID CRYSTAL DISPLAY AND METHOD OF CONTROLLING THE SAME

CROSS-REFERENCE TO RELATED APPLICATIONS

This application claims the benefit of Korea Patent Application No. 10-2008-128100 filed on Dec. 16, 2008, the entire contents of which is incorporated herein by reference for all purposes as if fully set forth herein.

BACKGROUND OF THE INVENTION

1. Field of the Invention

Embodiments of the present invention relate to a liquid crystal display and corresponding method for providing low power consumption in a self screen mode.

2. Description of the Related Art

Liquid crystal displays display an image by controlling a light transmittance of a liquid crystal layer through an electric field in response to a video signal. The liquid crystal display is also a flat panel display device having advantages such as a thin profile, a small size, and low power consumption. Thus, liquid crystal displays are used in personal computers such as notebook PCs, office automation equipment, audio/video equipment, and the like.

In addition, an active matrix type liquid crystal display includes a switching element formed in each liquid crystal cell. Therefore, the active matrix type liquid crystal display is advantageous for displaying a moving picture, because the switching elements can be actively controlled. Further, a thin film transistor (TFT) is used in the switching element of the active matrix type liquid crystal display.

In more detail, and with reference to FIG. 1, an active matrix type liquid crystal display converts digital video data into an analog data voltage based on a gamma reference voltage to supply the analog data voltage to a data line DL, and at the same time, to supply a scan pulse to a gate line GL. Hence, a liquid crystal cell Clc is charged to a data voltage. For the above-described operation, a gate electrode of a TFT is connected to the gate line GL, a source electrode of the TFT is connected to the data line DL, and a drain electrode of the TFT is connected to a pixel electrode of the liquid crystal cell Clc and an electrode at one side of a storage capacitor Cst. Further, a common voltage Vcom is supplied to a common electrode of the liquid crystal cell Clc.

When the TFT is turned on, the storage capacitor Cst is charged to the data voltage received from the data line DL to keep a voltage of the liquid crystal cell Clc constant. The TFT is turned on when the scan pulse is supplied to the gate line GL, the TFT is turned on. Thus, a channel is formed between the source electrode and the drain electrode of the TFT, and a voltage on the data line DL is supplied to the pixel electrode of the liquid crystal cell Clc. In addition, when an arrangement state of liquid crystal molecules of the liquid crystal cell Clc changes by an electric field between the pixel electrode and the common electrode, incident light is modulated.

However, the related art liquid crystal display has the following problems. First, when the liquid crystal display is used as a television, for example, and is mounted on a wall, the display has a dark or black appearance when it is not used. Further, many liquid crystal displays are large in size, and thus the liquid crystal display has an unattractive appearance when it is not being used, especially when the display is used in a home, office, work environment, etc. In addition, the amount of power consumption used by display has greatly increased especially with large sized and high definition (HD) liquid crystal displays. The high power consumption disadvantageously affects liquid crystal displays.

SUMMARY OF THE INVENTION

Accordingly, one object of the present invention is to address the above-noted and other drawbacks of the related art.

Another object of the present invention is to provide a liquid crystal display and corresponding method for providing low power consumption into a self screen mode and that has an enhanced appearance.

To achieve these and other advantages and in accordance with the purpose of the present invention, as embodied and broadly described herein, the present invention provides in one aspect a liquid crystal display including a liquid crystal display panel having at least first and second display portions, a first light emitting diode (LED) light source unit configured to selectively irradiate light onto the first display portion, a second LED light source unit configured to selectively irradiate light onto the second display portion, a light source drive circuit configured to individually drive the first and second LED light source units in response to an address signal, and a light source controller configured to generate and transmit, during a self screen mode in which a live image is not displayed, the address signal to the light source drive circuit to turn on the first LED light source unit and to turn off the second LED light source unit during a first time period, to turn on the first and second LED light source units during a second time period after the first time period, and to generate and transmit a dimming signal to the light source drive circuit to control a brightness of the first LED light source unit in the second time period to be lower than a brightness of the first LED light source unit in the first time period.

In another aspect, the present invention provides a method of controlling a liquid crystal display including a liquid crystal display panel having at least first and second display portions. The method includes selectively irradiating, via a first light emitting diode (LED) light source unit, light onto the first display portion; selectively irradiating, via a second LED light source unit, light onto the second display portion; individually driving, via a light source drive circuit, the first and second LED light source units in response to an address signal; and during a self screen mode in which a live image is not displayed, turning on the first LED light source unit and turning off the second LED light source unit during a first time period, turning on the first and second LED light source units during a second time period after the first time period, and controlling a brightness of the first LED light source unit in the second time period to be lower than a brightness of the first LED light source unit in the first time period.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
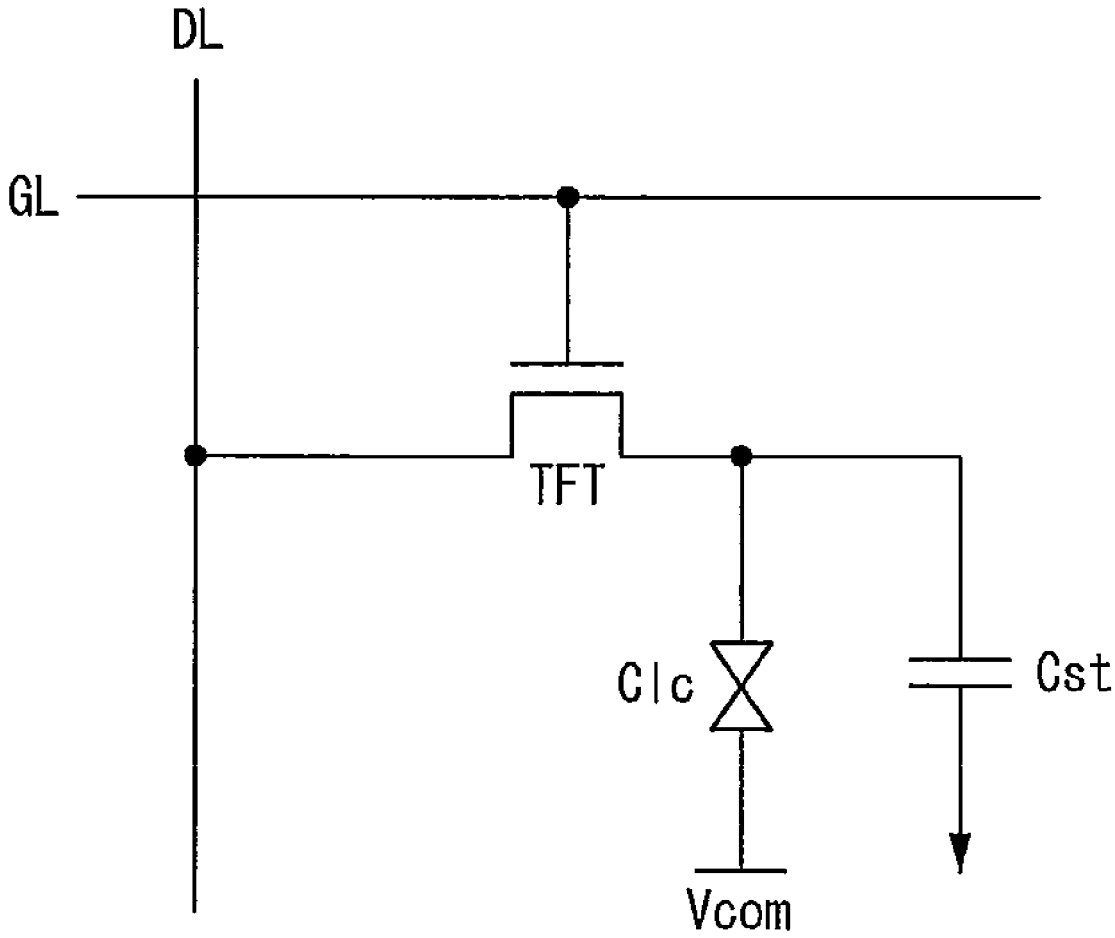
FIG. 1 (Related Art)
FIG. 1 is an equivalent circuit diagram of a pixel of a related art liquid crystal display.
Figure 2:
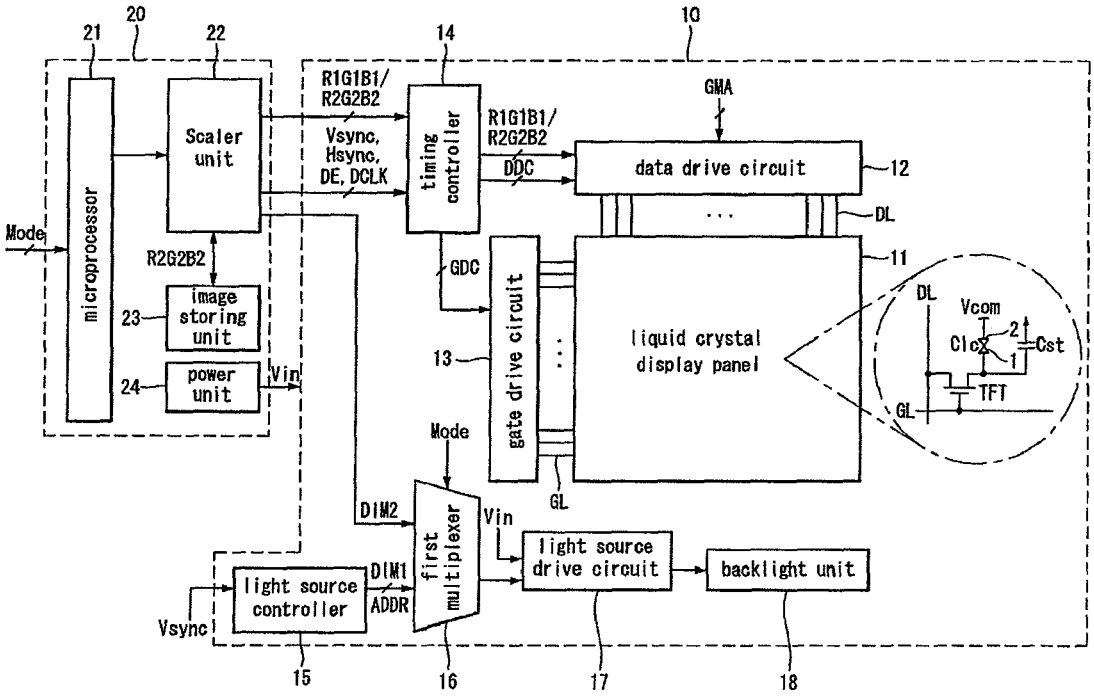
FIG. 2 is a block diagram of a liquid crystal display according to an embodiment of the invention.

FIG. 2 is a block diagram showing a configuration of a liquid crystal display according to an embodiment of the invention. As shown in FIG. 2, the liquid crystal display includes a liquid crystal module 10 displaying an image and a system module 20 supplying a driving signal to the liquid crystal module 10. Further, the liquid crystal module 10 includes a liquid crystal display panel 11, a data drive circuit 12, a gate drive circuit 13, a timing controller 14, a light source controller 15, a first multiplexer 16, a light source drive circuit 17, and a backlight unit 18.

The liquid crystal display according to an embodiment of the invention operates in a normal drive mode, in which video signals received from an external image medium are displayed, and in a standby mode, in which the liquid crystal display is in a standby state without displaying an image. In more detail, the normal drive mode corresponds to a live screen mode in which a live image is displayed (e.g., a movie, television station, etc.). In addition to the normal drive mode and the standby mode, the liquid crystal display according to the embodiment of the invention operates in a self-screen mode, in which previously stored video signals are displayed with a photograph frame appearance. More specifically, in the self-screen mode in the embodiment of the invention, when previously stored video signals are displayed on the liquid crystal display, light-on/off patterns of a plurality of light sources of a backlight unit are dynamically controlled in synchronization with a display timing.

In addition, the liquid crystal display panel 11 includes an upper glass substrate, a lower glass substrate, and a liquid crystal layer between the upper and lower glass substrates. The liquid crystal display panel 11 also includes m×n liquid crystal cells Clc arranged in a matrix format at each crossing of m data lines DL and n gate lines GL. The data lines DL, the gate lines GL, thin film transistors (TFTs), and a storage capacitor Cst are formed on the lower glass substrate of the liquid crystal display panel 11. Further, the liquid crystal cells Clc are connected to the TFTs and are driven by an electric field between pixel electrodes 1 and common electrodes 2.

In addition, a black matrix, a color filter, and the common electrodes 2 are formed on the upper glass substrate of the liquid crystal display panel 11. The common electrode 2 is formed on the upper glass substrate in a vertical electric drive manner, such as a twisted nematic (TN) mode and a vertical alignment (VA) mode. Also, the common electrode 2 and the pixel electrode 1 are formed on the lower glass substrate in a horizontal electric drive manner, such as an in-plane switching (IPS) mode and a fringe field switching (FFS) mode. Polarizing plates are also attached respectively to the upper and lower glass substrates, and alignment layers for setting a pre-tilt angle of the liquid crystal are respectively formed on the upper and lower glass substrates.

Further, the data drive circuit 12 converts a video signal (hereinafter, referred to as a first digital video data R1G1B1) for a normal drive or a video signal (hereinafter, referred to as a second digital video data R2G2B2) for a self screen drive into an analog gamma compensation voltage based on gamma reference voltages GMA received from a gamma reference voltage generation circuit (not shown) in response to a data control signal DDC received from the timing controller 14 to supply the analog gamma compensation voltage as a data voltage to the data lines DL of the liquid crystal display panel 11.

For the above-described operation, the data drive circuit 12 includes a plurality of data drive integrated circuits (ICs) each including a shift resistor, a resistor, a latch, a digital-to-analog converter (DAC), a multiplexer, an output buffer, and so on. The shift resistor samples a clock signal, and the resistor temporarily stores the first digital video data R1G1B1 or the second digital video data R2G2B2. The latch stores the digital video data R1G1B1/R2G2B2 every one line in response to the clock signal sampled by the shift resistor and simultaneously outputs the stored digital video data R1G1B1/R2G2B2 of each line. Further, the DAC selects a positive or negative gamma voltage based on a gamma reference voltage in response to a digital data value from the latch, and the multiplexer selects the data lines DL receiving analog data converted from the positive/negative gamma voltage. The output buffer is also connected between the multiplexer and the data lines DL.

In addition, the gate drive circuit 13 sequentially supplies scan pulses for selecting horizontal lines of the liquid crystal display panel 11, to which the data voltage will be supplied, to the gate lines GL. For the above operation, the gate drive circuit 13 includes a plurality of gate drive ICs each including a shift resistor, a level shifter for shifting an output signal of the shift resistor to a swing width suitable for a TFT drive of the liquid crystal cell Clc, and an output buffer connected between the level shifter and the gate lines GL.

Further, the timing controller 14 receives timing signals, such as horizontal and vertical sync signals Hsync and Vsync, a data enable signal DE, a dot clock signal DCLK from the system module 20 to generate a data timing control signal DDC for controlling an operation timing of the data drive circuit 12 and a gate timing control signal GDC for controlling an operation timing of the gate drive circuit 13. The data timing control signal DDC includes a source sampling clock signal SSC indicating a latch operation of digital data inside the data drive circuit 12 based on a rising or falling edge, a source output enable signal SOE indicating an output of the data drive circuit 12, a polarity control signal POL indicating a polarity of the data voltage to be supplied to the liquid crystal cells Clc of the liquid crystal display panel 11, and the like.

In addition, the gate timing control signal GDC includes a gate start pulse GSP, a gate shift clock signal GSC, a gate output enable signal GOE, and the like. The gate start pulse GSP indicates a start horizontal line of a scan operation during 1 vertical period in which one screen is displayed, and the gate shift clock signal GSC is a timing control signal that is input to the shift resistor of the gate drive circuit 13 to sequentially shift the gate start pulse GSP, and has a pulse width corresponding to on-period of a thin film transistor (TFT). Further, the gate output enable signal GOE indicates an output of the gate drive circuit 13.

Also, the timing controller 14 rearranges the first digital video data R1G1B1 or the second digital video data R2G2B2 received from the system module 20 in conformity with a resolution of the liquid crystal display panel 11 to supply the rearranged first digital video data R1G1B1 or the rearranged second digital video data R2G2B2 to the data drive circuit 12. In addition, the backlight unit 18 includes a plurality of light emitting diode (LED) light sources and irradiates light from the LED light sources driven by the light source drive circuit 17 onto the liquid crystal display panel 11. The backlight unit 18 may also be implemented as an edge-light type backlight unit in which the LED light sources are positioned opposite the side of a light guide plate, or a direct-light type backlight unit in which the LED light sources are positioned under a diffusion plate.

Further, the edge-light type backlight unit 18 converts light generated by the LED light sources in the form of a uniform surface light source using the light guide plate and a plurality of optical sheets stacked on the light guide plate to irradiate the light onto the liquid crystal display panel 11. Also, the direct-light type backlight unit 18 converts light generated by the LED light sources in the form of a uniform surface light source using the diffusion plate and a plurality of optical sheets stacked on the diffusion plate to irradiate the light onto the liquid crystal display panel 11.

In addition, the light source controller 15 generates a first dimming signal DIM1 and an address signal ADDR to dividedly drive the LED light sources in time and space aspects according to a previously determined light-on/off pattern group in a self screen drive mode. The light-on/off pattern group includes a plurality of light-on/off patterns that sequentially operate according to a previously determined time. The address signal ADDR indicates a location of LED light sources turned on according to each of the light-on/off patterns, and the first dimming signal DIM1 indicates a brightness of the turned-on LED light sources at the location indicated by the address signal ADDR.

Further, the number of turned-on LED light sources and/or the location of the turned-on LED light sources may vary according to a configuration of each of the light-on/off patterns. Also, the first dimming signal DIM1 has a dimming data value inversely proportional to the number of LED light sources turned on according to each of the previously determined light-on/off patterns, so that an average power consumed by the turned-on LED light sources in the self screen drive is within the range less than 10% of a power consumed by all the LED light sources of the backlight unit 18 in a global dimming drive.

That is, the dimming data value of the first dimming signal DIM1 is reduced as the number of turned-on LED light sources increases. For example, if a predetermined light-on/off pattern group includes a first light-on/off pattern and a second light-on/off pattern in which the number of turned-on LED light sources is more than the number of turned-on LED light sources in the first light-on/off pattern, the light source controller 15 turns on a first LED light source unit according to the first light-on/off pattern during a first period and turns on first and second LED light source units according to the second light-on/off pattern during a second period following the first period.

The light source controller 15 also allows a brightness of the first LED light source unit in the second period to be lower than a brightness of the first LED light source unit in the first period by controlling a dimming data value of the first dimming signal DIM1 so as to satisfy a desired power consumption. For this, a dimming data value for controlling the brightness of the first LED light source unit stepwise increases to a first critical value during a first half period of the first period, stepwise decreases to a second critical value smaller than the first critical value during a second half period of the first period, is kept at the second critical value during a first half period of the second period, and stepwise decreases to a minimum value during a second half period of the second period. On the other hand, a dimming data value for controlling a brightness of the second LED light source unit stepwise increases to the second critical value during the first half period of the second period and stepwise decreases to the minimum value during the second half period of the second period.

In addition, the first multiplexer 16 differently selects a dimming signal in response to a mode signal "Mode" received from the outside to supply the selected dimming signal to the light source drive circuit 17. More specifically, the first multiplexer 16 supplies the first dimming signal DIM1 and the address signal ADDR generated by the light source controller 15 to the light source drive circuit 17 in response to the mode signal "Mode" indicating the self screen drive mode. The first multiplexer 16 also supplies a second dimming signal DIM2 generated by the system module 20 to the light source drive circuit 17 in response to the mode signal "Mode" indicating the normal drive mode.

Further, the light source drive circuit 17 regulates a pulse width modulation (PWM) duty of the LED light sources in response to the first dimming signal DIM1 and the address signal ADDR in the self screen drive mode to adjust a luminance of light incident on the liquid crystal display panel 11. Also, the light source drive circuit 17 regulates a PWM duty of the LED light sources in response to the second dimming signal DIM2 in the normal drive mode to adjust a luminance of light incident on the liquid crystal display panel 11. Examples of an operation of the light source drive circuit 17 in the normal drive are disclosed in detail in Korea Patent Application Nos. 10-2008-0007282 (Jan. 23, 2008), 10-2008-0064969 (Jul. 4, 2008), 10-2008-0066511 (Jul. 9, 2008), and 10-2008-0066513 (Jul. 9, 2008) corresponding to the present applicant, and which are hereby incorporated by reference in their entirety.

In addition, as shown in FIG. 2, the system module 20 includes a microprocessor 21, a scaler unit 22, an image storing unit 23, and a power unit 24. The microprocessor 21 decides the mode signal "Mode" input through a user interface such as a remote controller and a selection button and generates a control signal for controlling an operation of the scaler unit 22 according to the decided result. More specifically, the microprocessor 21 generates a first control signal corresponding to an input of the mode signal "Mode" indicating the normal drive mode, a second control signal corresponding to an input of the mode signal "Mode" indicating the self screen drive mode, and a third control signal corresponding to a non-input of the mode signal "Mode".

In addition, the image storing unit 23 includes data update and erasable nonvolatile memory, for example, electrically erasable programmable read-only memory (EEPROM) and/or extended display identification data ROM (EDID ROM).

The image storing unit 23 stores the second digital video data R2G2B2 used to update a display image in the self screen drive. Further, the second digital video data R2G2B2 can be updated by an electrical signal that is received from the outside through the user interface.

Also, the scaler unit 22 operates in response to the first control signal from the microprocessor 21 to convert video data of various attributes that are received from a storage medium such as a DVD, CD and HDD, a TV receiving circuit, and the like in conformity with a display resolution and to perform a signal interpolation on the converted video data. Thus, the scaler unit 22 generates the first digital video data R1G1B1 and produces the second dimming signal DIM2 to supply the first digital video data R1G1B1 and the second dimming signal DIM2 to the liquid crystal module 10.

As a result, the liquid crystal module 10 displays an image in the normal drive mode. On the other hand, the scaler unit 22 extracts the second digital video data R2G2B2 stored in the image storing unit 23 in response to the second control signal from the microprocessor 21 to supply the second digital video data R2G2B2 to the liquid crystal module 10. As a result, the liquid crystal module 10 displays an image in the self screen mode. Further, in the normal drive mode and the self screen drive mode, the scaler unit 22 produces the timing signals Vsync, Hsync, DE, and DCLK synchronized with the digital video data R1G1B1 and R2G2B2 to supply the timing signals to the liquid crystal module 10.

In addition, if the scaler unit 22 receives the third control signal from the microprocessor 21, the scaler unit 22 stops operating. Hence, the liquid crystal module 10 operates in a standby mode. Further, the power unit 24 generates a DC voltage Vin required to operate the light source drive circuit 17.

Figure 3:
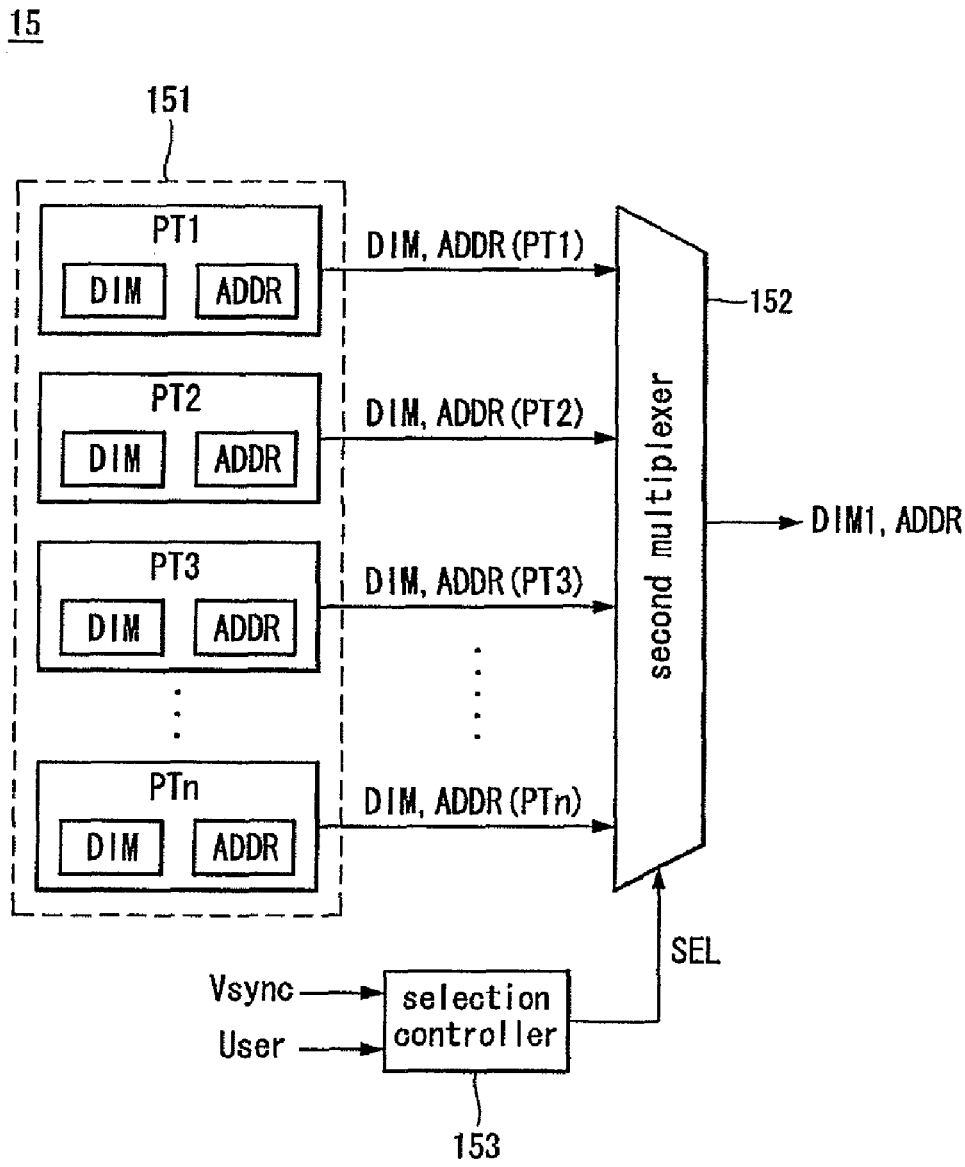
FIG. 3 illustrates an inner configuration of a light source controller according to an embodiment of the present invention.

Next, FIG. 3 is an overview illustrating an inner configuration of the light source controller 15. As shown in FIG. 3, the light source controller 15 includes a pattern information storing unit 151, a second multiplexer 152, and a selection controller 153. The pattern information storing unit 151 provides a plurality of previously determined light-on/off pattern groups PT1 to PTn. In addition, each of the light-on/off pattern groups PT1 to PTn includes a plurality of light-on/off patterns that sequentially operate according to a previously determined time. Each of the light-on/off patterns is also mapped to an address signal ADDR indicating a location of the turned-on LED light sources in a corresponding light-on/off pattern, and a dimming signal DIM indicating a brightness of the turned-on LED light sources at the location indicated by the address signal ADDR.

Figure 4A:
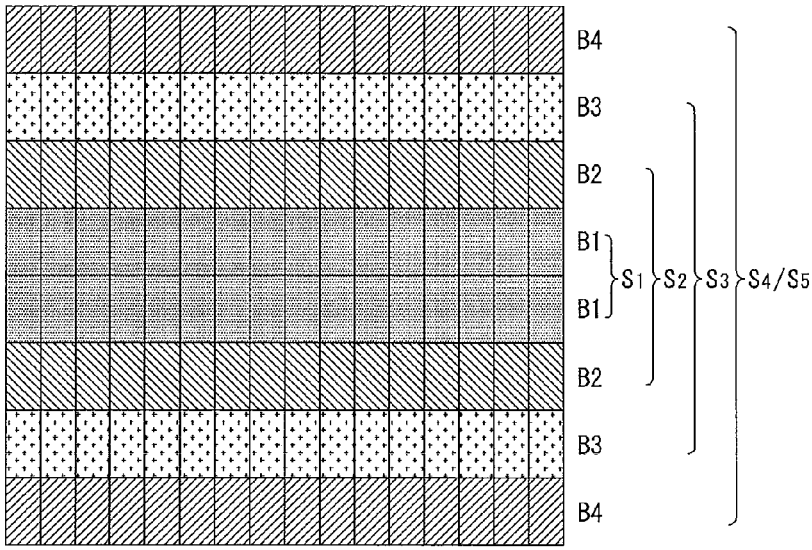
FIGS. 4A and 4B illustrate an example of light-on/off patterns according to an embodiment of the present invention.
Figure 4B:
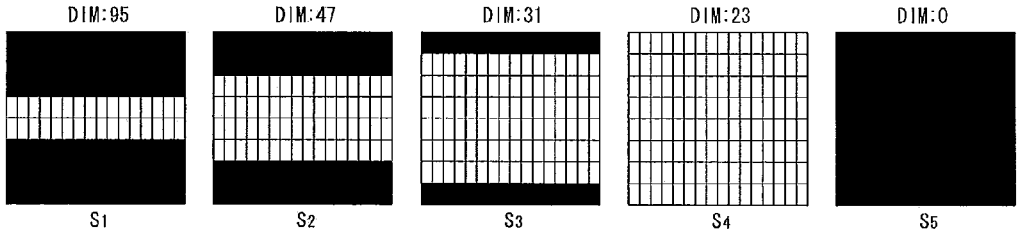

Next, FIGS. 4A and 4B illustrate an example of light-on/off patterns. In FIGS. 4A and 4B, the plurality of light-on/off pattern groups PT1 to PTn includes a first light-on/off pattern S1 represented when LED light sources positioned in a first block B1 are turned on, a second light-on/off pattern S2 represented when LED light sources positioned in first and second blocks B1 and B2 are turned on, a third light-on/off pattern S3 represented when LED light sources positioned in first to third blocks B1 to B3 are turned on, a fourth light-on/off pattern S4 represented when LED light sources positioned in all of blocks B1 to B4 are turned on, and a fifth light-on/off pattern S5 represented when the LED light sources positioned in all the blocks B1 to B4 are turned off.

In addition, each of the first to fourth light-on/off patterns S1 to S4 is mapped to a critical dimming data value inversely proportional to the size of the light-on block so that the first to fourth light-on/off patterns S1 to S4 have an substantially equal average power consumption within the range less than 10% of a power consumed by the LED light sources in all the blocks B1 to B4 in a global dimming drive. More specifically, as the size of the light-on block increases according to a pattern change from the first light-on/off pattern S1 to the fourth light-on/off pattern S4, the critical dimming data value stepwise decreases to '95', '47', '32', and '23'.

Further, the critical dimming data value '95' is a dimming data value corresponding to a brightness of 95-gray level when it is assumed that 255-gray level is a peak white gray level, and has a brightness ratio of '95/255', and the critical dimming data value '47' is a dimming data value corresponding to a brightness of 47-gray level when it is assumed that 255-gray level is a peak white gray level and has a brightness ratio of '47/255'. In addition, the critical dimming data value '32' is a dimming data value corresponding to a brightness of 32-gray level when it is assumed that 255-gray level is a peak white gray level and has a brightness ratio of '32/255', and the critical dimming data value '23' is a dimming data value corresponding to a brightness of 23-gray level when it is assumed that 255-gray level is a peak white gray level, and has a brightness ratio of '23/255'.

Figure 5:
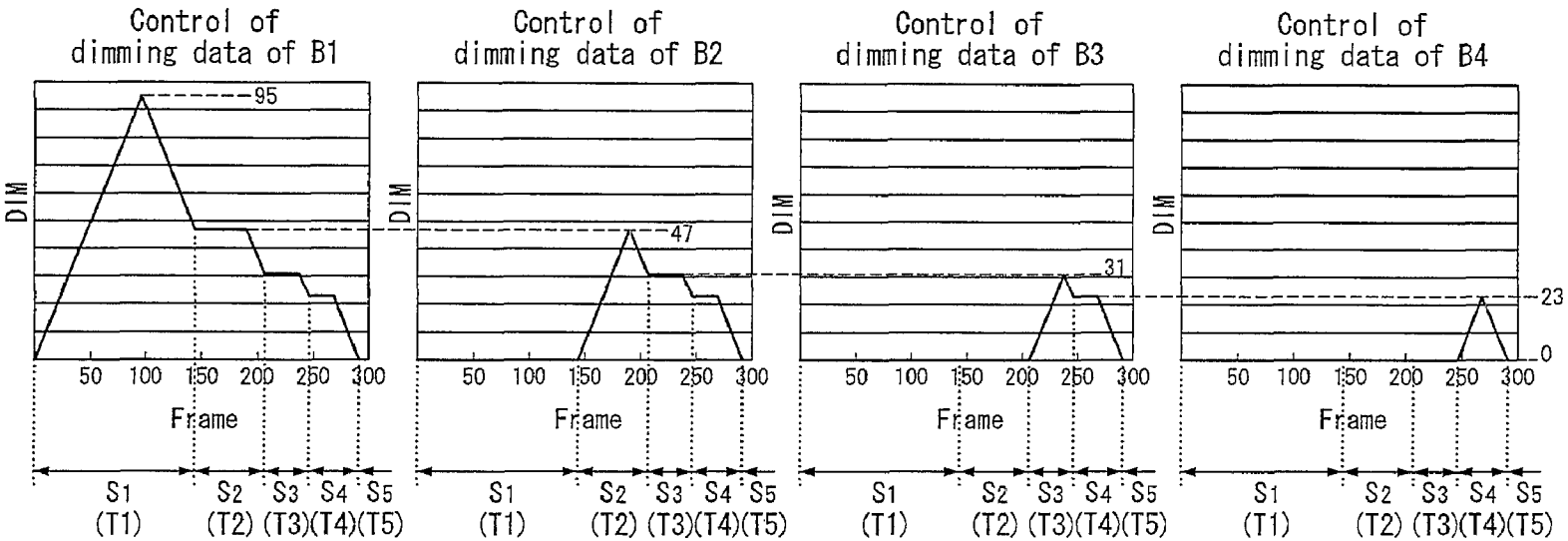
FIG. 5 illustrates a method of controlling dimming data in each of blacks constituting light-on/off patterns according to an embodiment of the present invention.

In addition, the dimming data value of each of the light-on/off patterns stepwise changes by a dimming data value having a minimum magnitude and converges to a critical value of each light-on/off pattern so that a flicker is not generated between the light-on/off patterns. In more detail, FIG. 5 illustrates a method of controlling dimming data in each block constituting light-on/off patterns. As shown in FIG. 5, a dimming data value of the first block B1 stepwise increases to a first critical value '95' during a first half period of a first period T1 in which the first light-on/off pattern S1 operates, and then stepwise decreases to a second critical value '47' during a second half period of the first period T1.

Further, the dimming data value of the first block B1 is kept at the second critical value '47' during a first half period of a second period T2 in which the second light-on/off pattern S2 operates, and then stepwise decreases to a third critical value '31' during a second half period of the second period T2. Also, the dimming data value of the first block B1 is kept at the third critical value '31' during a first half period of a third period T3 in which the third light-on/off pattern S3 operates, and then stepwise decreases to a fourth critical value '23' during a second half period of the third period T3.

In addition, the dimming data value of the first block B1 is kept at the fourth critical value '23' during a first half period of a fourth period T4 in which the fourth light-on/off pattern S4 operates, and then stepwise decreases to a minimum value '0' during a second half period of the fourth period T4. Further, the dimming data value of the first block B1 is kept at the minimum value '0' during a fifth period T5 in which the fifth light-on/off pattern S5 operates. The minimum value '0' indicates a dimming data value corresponding to a brightness of a black gray level.

In addition, the dimming data value of the second block B2 is kept at the minimum value '0' during the first period T1. The dimming data value of the second block B2 also stepwise increases to the second critical value '47' during the first half period of the second period T2, and then stepwise decreases to the third critical value '31' during the second half period of the second period T2. Further, the dimming data value of the second block B2 is kept at the third critical value '31' during the first half period of the third period T3, and then stepwise decreases to the fourth critical value '23' during the second half period of the third period T3.

Also, as shown in FIG. 5, the dimming data value of the second block B2 is kept at the fourth critical value '23' during the first half period of the fourth period T4, and then stepwise decreases to the minimum value '0' during the second half period of the fourth period T4. The dimming data value of the second block B2 is kept at the minimum value '0' during the fifth period T5. In addition, a dimming data value of the third block B3 is kept at the minimum value '0' during the first and second periods T1 and T2. The dimming data value of the third block B3 also stepwise increases to the third critical value '31' during the first half period of the third period T3, and then stepwise decreases to the fourth critical value '23' during the second half period of the third period T3. The dimming data value of the third block B3 is kept at the fourth critical value '23' during the first half period of the fourth period T4, and then stepwise decreases to the minimum value '0' during the second half period of the fourth period T4. The dimming data value of the third block B3 is then kept at the minimum value '0' during the fifth period T5.

Further, a dimming data value of the fourth block B4 is kept at the minimum value '0' during the first to third periods T1 to T3. The dimming data value of the fourth block B4 stepwise also increases to the fourth critical value '23' during the first half period of the fourth period T4, and then stepwise decreases to the minimum value '0' during the second half period of the fourth period T4. The dimming data value of the fourth block B4 is also kept at the minimum value '0' during the fifth period T5.

Figure 6:
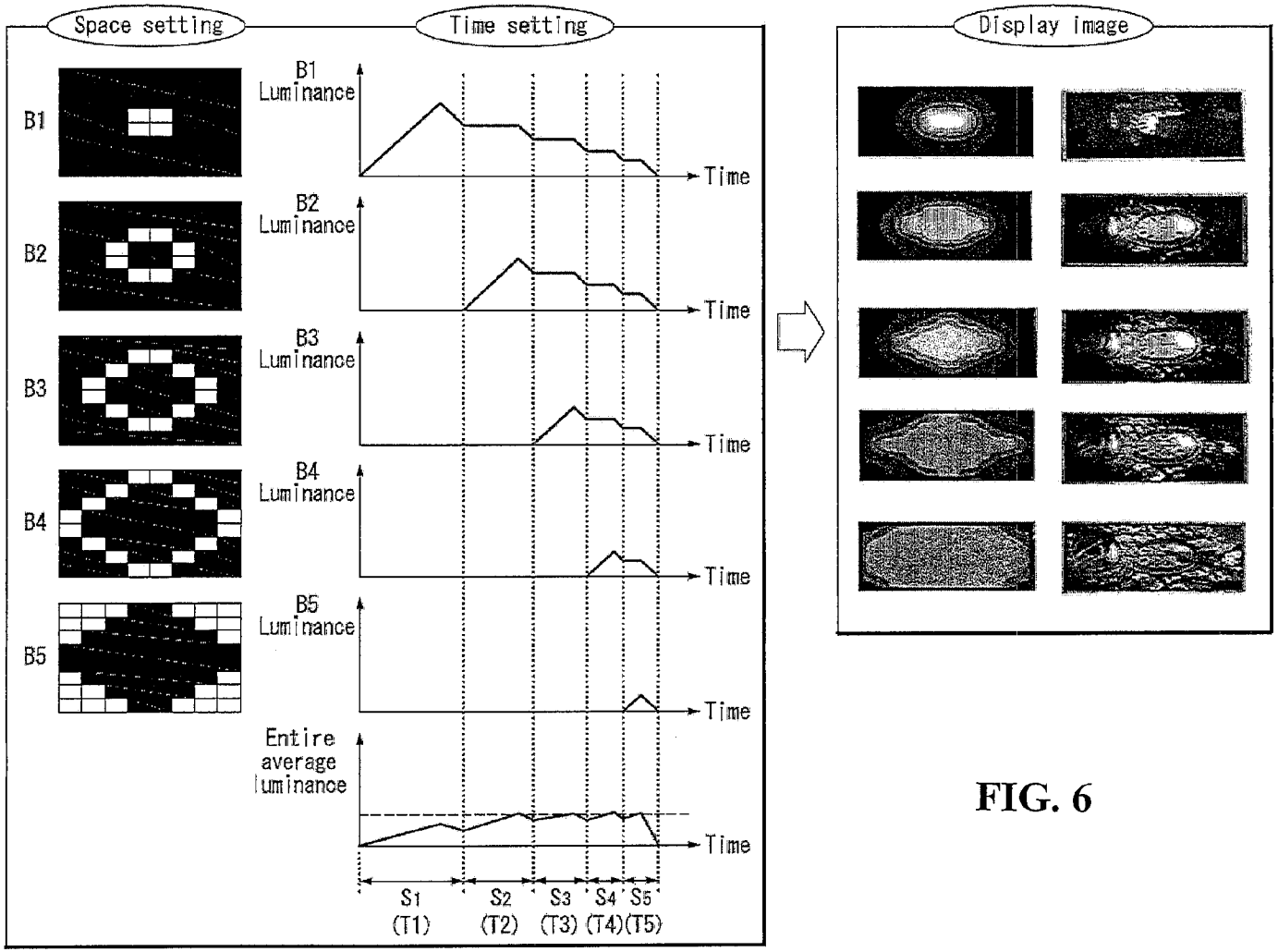
FIG. 6 illustrates another example of light-on/off patterns and a method of controlling dimming data in each of blacks constituting the light-on/off patterns according to an embodiment of the present invention.

Next, FIG. 6 illustrates another example of light-on/off patterns and method of controlling dimming data in each block constituting light-on/off patterns according to an embodiment of the present invention. As shown, the plurality of light-on/off pattern groups PT1 to PTn includes a first light-on/off pattern S1 represented when LED light sources positioned in a first block B1 are turned on, a second light-on/off pattern S2 represented when LED light sources positioned in first and second blocks B1 and B2 are turned on, a third light-on/off pattern S3 represented when LED light sources positioned in first to third blocks B1 to B3 are turned on, a fourth light-on/off pattern S4 represented when LED light sources positioned in all of blocks B1 to B4 are turned on, and a fifth light-on/off pattern S5 represented when the LED light sources positioned in all the blocks B1 to B4 are turned off.

In addition, each of the first to fourth light-on/off patterns S1 to S4 is mapped to a critical dimming data value inversely proportional to the size of the light-on block so that the first to fourth light-on/off patterns S1 to S4 have an substantially equal average power consumption within the range less than 10% of a power consumed by the LED light sources in all the blocks B1 to B4 in a global dimming dive. As shown in the display image in FIG. 6, as the size of the light-on block increases, a luminance in a light-on portion decreases. However, an average luminance in each of the blocks B1 to B4 is kept approximately constant around a desired luminance.

Figure 7:
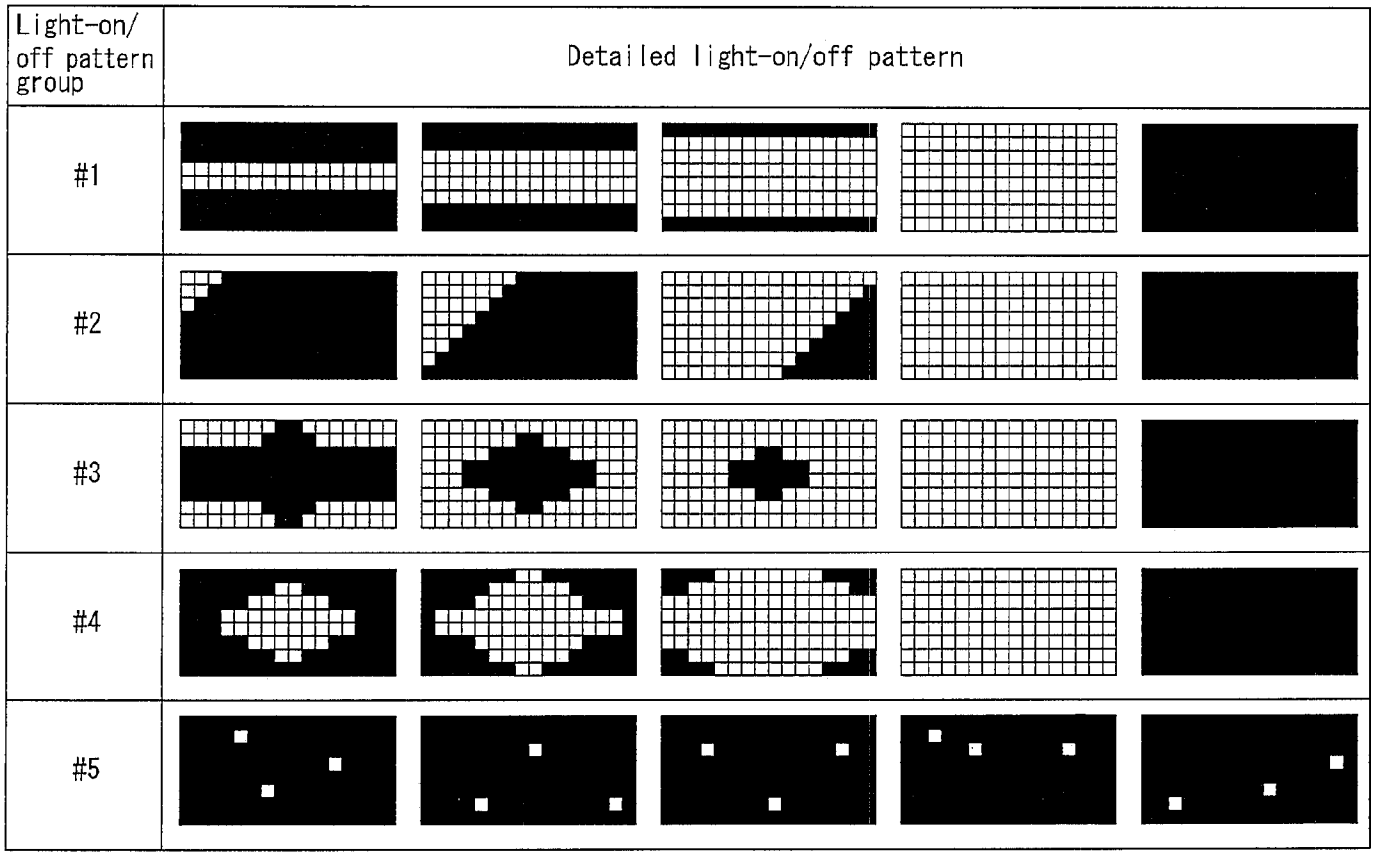
FIG. 7 illustrates an example of light-on/off pattern groups according to an embodiment of the present invention.

Next, FIG. 7 illustrates an example of light-on/off pattern groups according to an embodiment of the present invention. In more detail, FIG. 7 illustrates a plurality of light-on/off pattern groups #1 to #5. In addition, the light-on/off pattern groups #1 to #5 include a transverse extension light-on/off pattern group #1, a diagonal extension light-on/off pattern group #2, a waterdrop close light-on/off pattern group #3, a waterdrop open light-on/off pattern group #4, and a black random light-on/off pattern group #5. Also, each of the light-on/off pattern groups #1 to #5 includes a plurality of light-on/off patterns. Further, each of the light-on/off patterns belonging to each of the light-on/off pattern groups #1 to #5 is mapped to an address signal ADDR, that indicates a location of the turned-on LED light sources in a corresponding light-on/off pattern, and a dimming signal DIM that indicates a brightness of the turned-on LED light sources at the location indicated by the address signal ADDR.

In addition, the selection controller 153 generates a selection signal SEL for selecting one of the light-on/off pattern groups #1 to #5 using user information "User" input through the user interface such as the remote controller and the selection button and a vertical sync signal Vsync. When the selected light-on/off pattern group is previously set at a default value depending on a display state of the second digital video data R2G2B2, the selection signal SEL may be differently generated depending on the display state of the second digital video data R2G2B2.

Further, the second multiplexer 152 selects one of the light-on/off pattern groups #1 to #5 depending on the selection signal SEL generated by the selection controller 153 or the selection signal SEL mapped to the default value depending on the display state of the second digital video data R2G2B2. Then, the second multiplexer 152 outputs location information and brightness information of the light-on/off patterns belonging to the selected light-on/off pattern group in the form of as the address signal ADDR and the dimming signal DIM.

Figure 8:
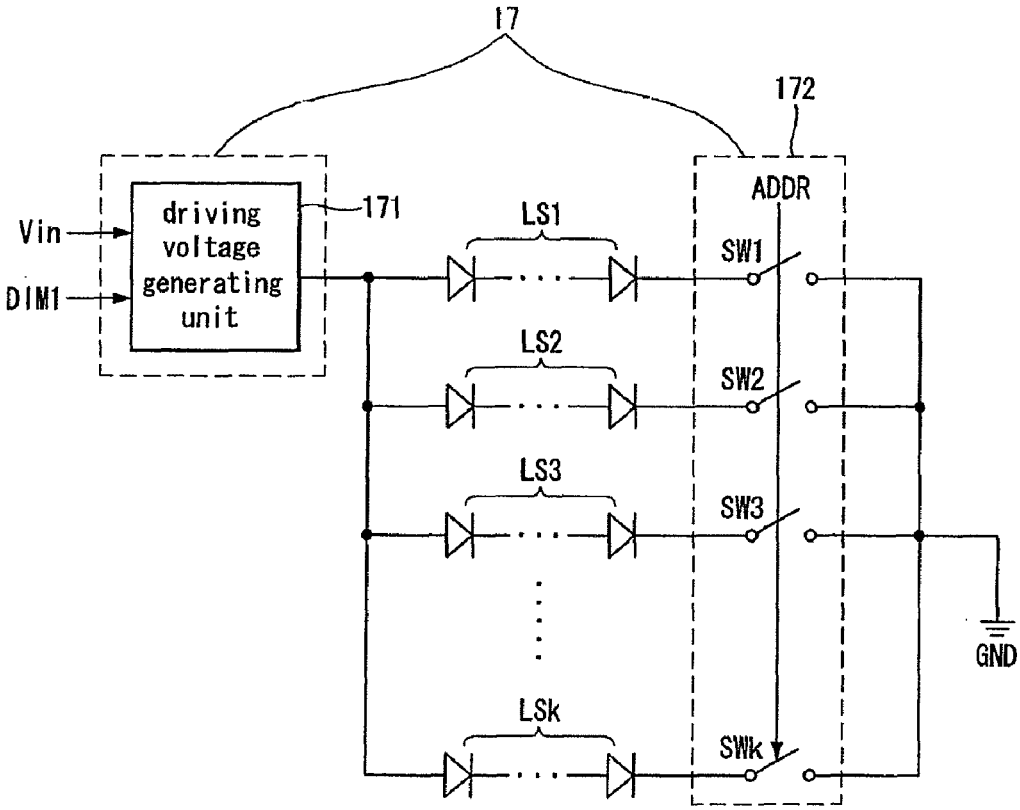
FIG. 8 illustrates an operation of a light source drive circuit in a self screen drive mode according to an embodiment of the present invention.

Next, FIG. 8 illustrates an operation of the light source drive circuit 17 in the self screen drive mode according to an embodiment of the present invention. As shown in FIG. 8, the light source drive circuit 17 includes a driving voltage generation unit 171 and a switch array 172. Further, LED light sources connected to the light source drive circuit 17 include a plurality of LED rows LS1 to LSk each having at least two LED light sources connected in series. Also, the DC voltage Vin from the system module 20 is supplied to a power input terminal of the driving voltage generation unit 171, and anode terminals of the LED rows LS1 to LSk are connected to the power input terminal of the driving voltage generation unit 171.

In addition, the driving voltage generation unit 171 generates an LED driving voltage in conformity with a dimming data value included in the first dimming signal DIM1 based on the first dimming signal DIM1 received from the light source controller 15, and then supplies the LED driving voltage to the LED light sources through the power input terminal of the driving voltage generation unit 171. As the dimming data value of the first dimming signal DIM1 increases, the LED driving voltage increases. Also, as the dimming data value of the first dimming signal DIM1 decreases, the LED driving voltage decreases. Further, the switch array 172 includes a plurality of switches SW1 to SWk connected between cathode terminals of the LED rows LS1 to LSk and a ground level voltage source GND. The switch array 172 is also switched on or off in response to the address signal ADDR from the light source controller 15 to determine the LED light sources to be turned on.

As described above, in the liquid crystal display according to the embodiments of the invention, the interior appearance of the display can be enhanced and by reducing power consumption advantageously controlling the LED light sources. Furthermore, in the liquid crystal display according to the embodiments of the invention, the entire brightness of the liquid crystal display panel can be kept constant irrespective of the number of turned-on LED light sources by controlling the dimming signal depending on the number of turned-on LED light sources. Therefore, when a small number of LED light sources are turned on, a display image is not dark but bright. In other words, because the dimming signal changes depending on the previously determined light-on/off patterns, a display image is not dark but bright even if a small number of LED light sources are turned on.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel having at least first and second display portions;

a first LED light source unit configured to selectively irradiate light onto the first display portion;

a second LED light source unit configured to selectively irradiate light onto the second display portion;

a light source drive circuit configured to individually drive the first and second LED light source units in response to an address signal; and a light source controller configured to generate the address signal and transmit the address signal to the light source drive circuit to turn on the first LED light source unit and to turn off the second LED light source unit during a first time period, to turn on the first and second LED light source units during a second time period after the first time period in a self screen mode in which a live image is not displayed wherein the light source controller is further configured to generate the dimming signal to stepwise increase to a first critical value during a first half of the first time period, to stepwise decrease to a second critical value smaller than the first critical value during a second half of the first time period, to maintain the second critical value during a first half of the second time period, and to stepwise decrease to a minimum value during a second half of the second time period in the self screen mode.

2. The liquid crystal display of claim 1, wherein the light source controller is further configured to generate the dimming signal to stepwise increase to the second critical value during the first half of the second time period and to stepwise decrease to the minimum value during the second half of the second time period.

3. The liquid crystal display of claim 1, further comprising:

a mode selection unit configured to receive a mode selection signal indicating a selection of the self screen mode or a selection of a live screen mode, wherein the light source controller is further configured to generate the address signal and the dimming signal upon receiving the mode selection signal indicating the selection of the self screen mode.

4. The liquid crystal display of claim 3, further comprising:

a receiver configured to receive first digital video data from an external source; and a display panel controller configured to display the live image corresponding to the first digital video data on the liquid crystal panel during the live screen mode.

5. The liquid crystal display of claim 4, further comprising:

a memory configured to store second digital video data that is different than the first digital video data, wherein the display panel controller is further configured to display a self screen image corresponding to the second digital video data on the liquid crystal display panel during the self screen mode.

6. The liquid crystal display of claim 5, further comprising:

a data drive circuit configured to convert the first digital video data for the live screen mode or the second digital video data for the self screen mode into an analog voltage and to supply the voltage as a data voltage to data lines of the liquid crystal display panel;

a gate drive circuit configured to sequentially supply scan pulses to gate lines crossing with the data lines, said scan pulses turning on TFTs arranged at crossings of the data lines and the gate lines such that a corresponding liquid crystal cell is charged to the data voltage; and a timing controller configured to control the data drive circuit and the gate driver circuit.

7. The liquid crystal display of claim 1, wherein the light source drive circuit is further configured to drive the first and second LED light source units so an amount of power consumed by the first LED light source unit turned on during the first time period is substantially equal to an amount of power consumed by the first and second LED light source units turned on during the second time period.

8. The liquid crystal display of claim 7, wherein the liquid crystal display panel further includes at least third and fourth display portions, wherein the liquid crystal display further comprises:

a third LED light source unit configured to irradiate light onto the third display portion; and a fourth LED light source unit configured to irradiate light onto the fourth display portion, wherein the light source drive circuit is further configured to individually drive the third and fourth LED light source units in response to the address signal and to control a brightness of each of the first to fourth LED light source units in response to the dimming signal, and wherein the light source controller is further configured to generate and transmit the address signal to the light source drive circuit during the self screen mode to turn on the first to third LED light source units during a third time period, to turn on the first to fourth LED light source units during a fourth time period, and to generate the dimming signal to control a brightness of the second LED light source unit in the third time period to be lower than a brightness of the second LED light source unit in the second time period and to control a brightness of the fourth LED light source unit in the third time period to be lower than a brightness of the third LED light source unit in the third time period.

9. The liquid crystal display of claim 8, wherein the light source controller is further configured to control the first and second LED light source units so that the brightness of the second LED light source unit is substantially equal to the brightness of the first LED light source unit in the second time period, to control the third LED light source unit so that the brightness of the third LED light source unit is substantially equal to a brightness of the first and second LED light source units in the third time period, to control the fourth LED light source unit so that the brightness of the fourth LED light source unit is substantially equal to a brightness of the first to third LED light source units in the fourth time period, and to simultaneously turn off the first to fourth LED light source units using the dimming signal and the address signal in a fifth time period.

10. The liquid crystal display of claim 9, further comprising:

a display controller configured to supply data to be displayed on the first to third display surfaces during the third time period to the liquid crystal display and to supply data to be displayed on the first to fourth display surfaces during the fourth time period to the liquid crystal display panel during the self screen mode.

11. The liquid crystal display of claim 10, wherein the light source controller comprises:

a memory configured to store a plurality of light-on/off pattern groups, wherein the light source controller is further configured to turn on/off the first to fourth LED light source units in each of the first to fifth time periods according to each of the plurality of light-on/off pattern groups stored in the memory; and a selection unit configured to select one of the plurality of light-on/off pattern groups.

12. A method of controlling a liquid crystal display including a liquid crystal display panel having at least first and second display portions, the method comprising:

selectively irradiating, via a first LED light source unit, light onto the first display portion;

selectively irradiating, via a second LED light source unit, light onto the second display portion;

individually driving, via a light source drive circuit, the first and second LED light source units in response to an address signal; and in a self screen mode in which a live image is not displayed, turning on the first LED light source unit and turning off the second LED light source unit during a first time period, turning on the first and second LED light source units during a second time period after the first time period, and controlling a brightness of the first LED light source unit via a dimming signal that stepwise increases to a first critical value during a first half of the first time period, stepwise decreases to a second critical value smaller than the first critical value during a second half of the first time period, maintains the second critical value during a first half of the second time period, and stepwise decreases to a minimum value during a second half of the second time period.

13. The method of claim 12, wherein the dimming signal stepwise increases to the second critical value during the first half of the second time period and stepwise decreases to the minimum value during the second half of the second time period.

14. The method of claim 12, further comprising:

receiving a mode selection signal indicating a selection of the self screen mode or a selection of a live screen mode;

receiving first digital video data from an external source; and displaying the live image corresponding to the first digital video data on the liquid crystal panel during the live screen mode.

15. The method of claim 14, further comprising:

storing second digital video data that is different than the first digital video data; and display a self screen image corresponding to the second digital video data on the liquid crystal display panel during the self screen mode.

16. The method of claim 12, further comprising:

driving the first and second LED light source units so an amount of power consumed by the first LED light source unit turned on during the first time period is substantially equal to an amount of power consumed by the first and second LED light source units turned on during the second time period.

17. The method of claim 16, wherein the liquid crystal display panel further includes at least third and fourth display portions, and wherein the method further comprises:

irradiating, via a third LED light source unit, light onto the third display portion;

irradiating, via a fourth LED light source unit, light onto the fourth display portion;

individually driving the third and fourth LED light source units in response to the address signal and to control a brightness of each of the first to fourth LED light source units in response to the dimming signal; and during the self screen mode, turning on the first to third LED light source units during a third time period, turning on the first to fourth LED light source units during a fourth time period, controlling a brightness of the second LED light source unit in the third time period to be lower than a brightness of the second LED light source unit in the second time period, and controlling a brightness of the fourth LED light source unit in the third time period to be lower than a brightness of the third LED light source unit in the third time period.

18. The method of claim 17, further comprising:

during the self screen mode, controlling the first and second LED light source units so that the brightness of the second LED light source unit is substantially equal to the brightness of the first LED light source unit in the second time period, controlling the third LED light source unit so that the brightness of the third LED light source unit is substantially equal to a brightness of the first and second LED light source units in the third time period, controlling the fourth LED light source unit so that the brightness of the fourth LED light source unit is substantially equal to a brightness of the first to third LED light source units in the fourth time period, and simultaneously turning off the first to fourth LED light source units using the dimming signal and the address signal in a fifth time period.

* * * * *